United States Patent [19]

Palamara

[11] 3,957,174

[45] May 18, 1976

[54] STORAGE AND DISPENSER UNIT FOR BOXES

[75] Inventor: Joseph P. Palamara, Tenafly, N.J.

[73] Assignee: Display Originals, Inc., West Babylon, N.Y.

[22] Filed: Dec. 16, 1974

[21] Appl. No.: 532,858

[52] U.S. Cl. ..... 221/111; 211/49 D; 221/309

[51] Int. Cl.[2] ..... A47F 1/08

[58] Field of Search ..... 221/92, 307–310, 221/111; 211/49 D; 312/42

[56] References Cited

UNITED STATES PATENTS

| | | | |
|---|---|---|---|
| 2,231,091 | 2/1941 | Saulsbury | 221/307 X |
| 3,037,638 | 6/1962 | Nealy | 211/49 D |
| 3,858,757 | 1/1975 | Langdon | 221/309 X |
| D198,295 | 5/1964 | DiDomenico et al. | D80/9 |

*Primary Examiner*—Robert B. Reeves
*Assistant Examiner*—Francis J. Bartuska

[57] ABSTRACT

A vertically-mountable storage and dispenser unit for holding and individually dispensing a large number of small boxes. The unit is constituted by a frame having a rectangular back wall and a pair of side walls secured to the edges of the back wall to create a channel. Projecting inwardly from each side wall is a series of stepped ledges each pair of which defines a distinct sub-channel for receiving boxes, the lower end of each sub-channel having a stop to hold the boxes therein. The leading edges of the ledges are staggered with respect to the back wall to provide discharge openings for lateral removal of the boxes from the subchannels. The sides of the ledges are staggered with respect to the back wall, each front ledge registering with an opening formed in the adjacent ledge which in turn registers with an opening in the next ledge, the rear ledge registering with an opening in the back wall whereby the unit may be injection molded in a one-piece operation.

1 Claim, 10 Drawing Figures

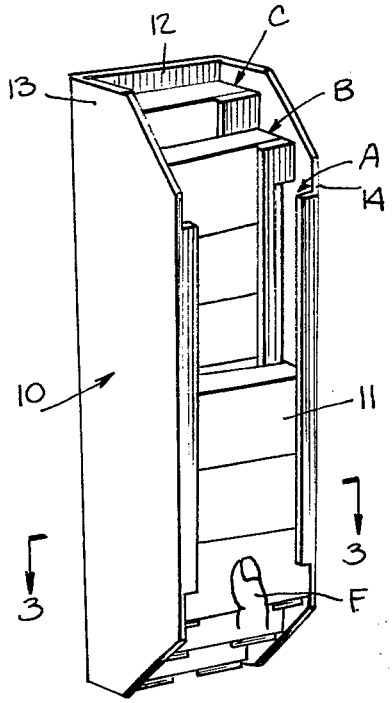
Fig. 1.
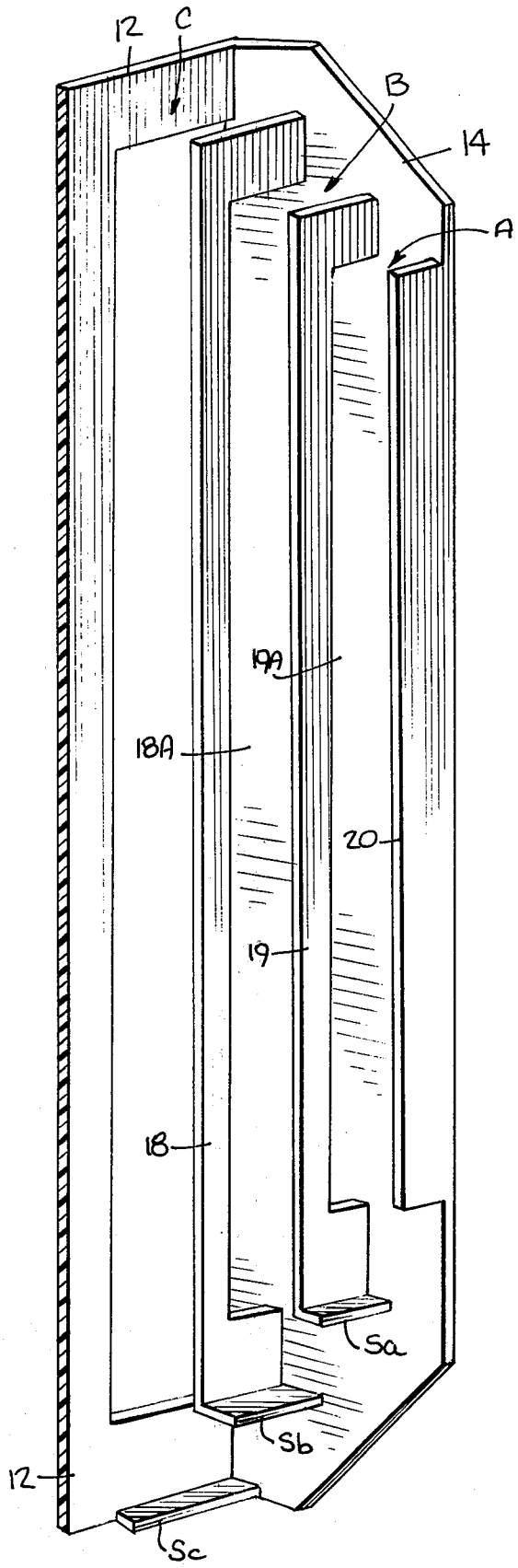
Fig. 2.
Fig. 3.
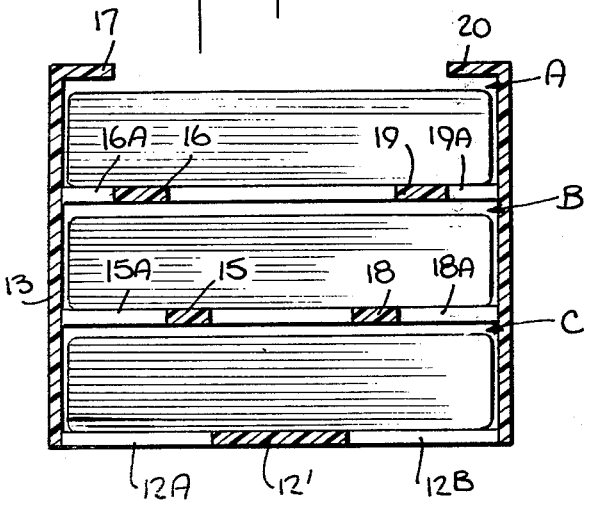

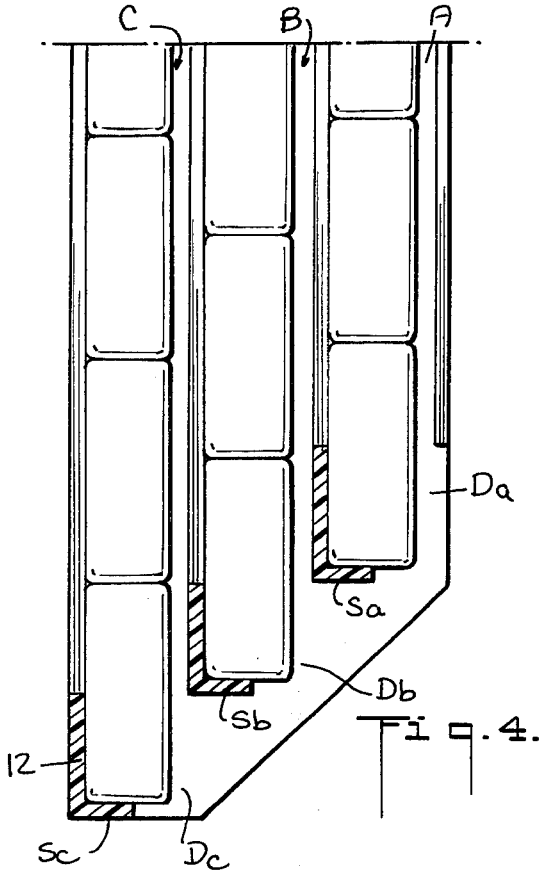
Fig. 4.
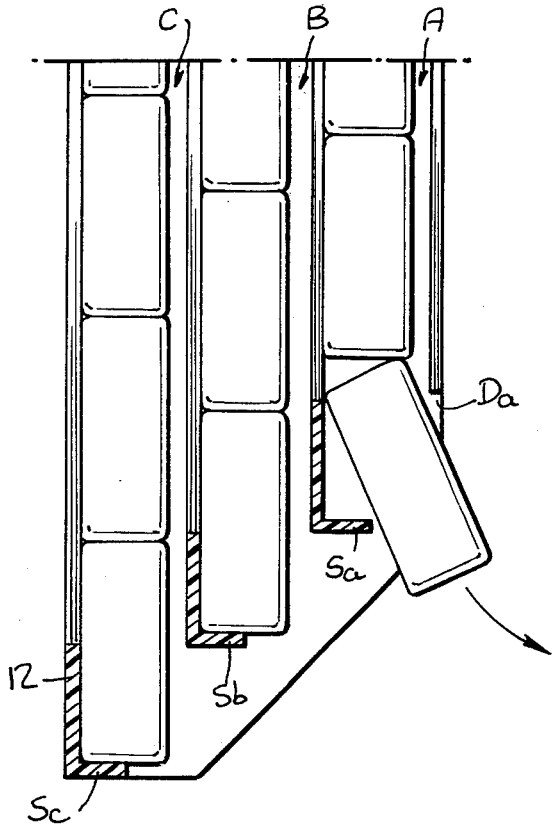
Fig. 5.
Fig. 6.
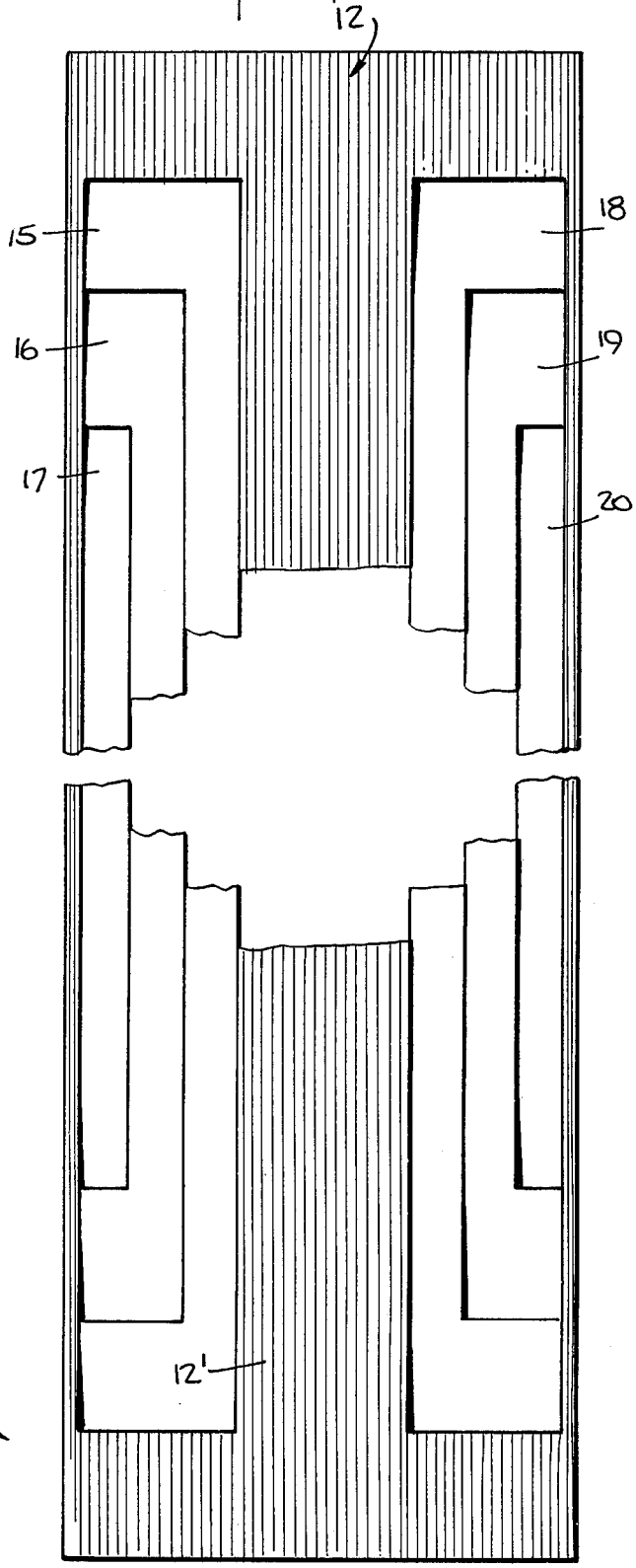

STORAGE AND DISPENSER UNIT FOR BOXES

BACKGROUND OF THE INVENTION

This invention relates generally to storage and dispenser units for boxed goods, and more particularly to a compact unit having a high capacity, which unit may be injection molded in a one-piece operation.

In the merchandising of candy and other products contained in small boxes, it is desirable that the product be attractively displayed in order to draw customers. The display on the counter of single box is not feasible, for then the box is obscured by many other competing products. Moreover when the product is advertised by a counter display card, but the supply of boxes is at another location, then should a customer seek to make a purchase, the sales person must leave the counter to find the supply and take a box therefrom, thereby complicating the transaction.

In order to provide dispensers which act both to store and display small containers of merchandise, it is known to provide units for this purpose which may be suspended from a wall or placed on the counter to attract customers and facilitate purchases. But units of the type heretofore known have a small capacity and are of relatively complex and costly construction.

Moreover existing types of dispensers fail to protect the boxes against theft. For example in one widely-used dispenser for boxes containing candy mints, the unit is composed of a vertical array of inclined cells, each accommodating a single box. Any one of these boxes may be removed without regard to the other boxes in the array so that instead of removing a single box, one having access to the unit may quickly remove 5 or 10 boxes.

SUMMARY OF THE INVENTION

In view of the foregoing, it is the main object of this invention to provide an improved storage and dispenser unit for boxed goods, which unit is usable as a display merchandiser, as a counter display, as a hanging dispenser or as a package for a large number of boxes.

More particularly, it is an object of this invention to provide a unit of the above-type constituted by a frame having a pair of side walls from which ledges project that divide the frame into distinct compartments for accommodating the boxes to be stored, each compartment having a discharge opening permitting lateral withdrawal of boxes therefrom, one at a time.

A significant feature of one preferred embodiment of the invention resides in the fact that the design of the unit inherently lends itself to injection molding in a one-piece molding operation, whereby the unit, when withdrawn from the mold is ready for use. Thus the units may be mass-produced at a relatively low cost.

Also an object of the invention is to provide an inexpensive unit of the above type which is adapted to store a large number of relatively fragile boxes and to protect them against mishandling and damage.

A salient advantage of a multi-compartment storage and dispenser unit in accordance with the invention is that while the compartments have their own discharge openings, each compartment, as long as it contains at least one box, effectively blocks the opening in the adjacent compartment, so that only a single box may be removed at a time, thereby minimizing illicit withdrawals.

Briefly stated, in one embodiment of the invention these objects are attained in a vertically-mountable storage unit for holding and dispensing small boxes, the unit comprising a frame having a rectangular back wall and a pair of side walls secured to the edges of the back wall to create a channel which is divided into parallel sub-channels by a series of stepped ledges projecting from the side walls.

The leading edges of the ledges are staggered with respect to the back wall to provide discharge openings for lateral removal of boxes held in the sub-channels. The sides of the ledges are staggered with respect to the back wall, each front ledge registering with a like-shaped opening in the adjacent ledge which, in turn, registers with an opening in the next ledge, the rear ledge in the series thereof registering with an opening in the back wall whereby the unit may be injection molded in a one-piece operation.

OUTLINE OF THE DRAWINGS

For a better understanding of the invention as well as other objects and further features thereof, reference is made to the following detailed description to be read in conjunction with the accompanying drawing, wherein:

FIG. 1 is a perspective view of one preferred embodiment of a storage and dispenser unit in accordance with the invention for holding and dispensing a large number of small boxes;

FIG. 2 is an enlarged view of one half of the unit to better reveal the ledge arrangement thereof;

FIG. 3 is a transverse section taken in the plane indicated by line 3—3 in FIG. 1;

FIG. 4 is a longitudinal section taken through the lower half of the unit;

FIG. 5 is the same as FIG. 4, except that it shows the withdrawal of one of the boxes from the front sub-channel;

FIG. 6 is a rear view of the unit;

DESCRIPTION OF THE INVENTION

First Embodiment

Figure 10:
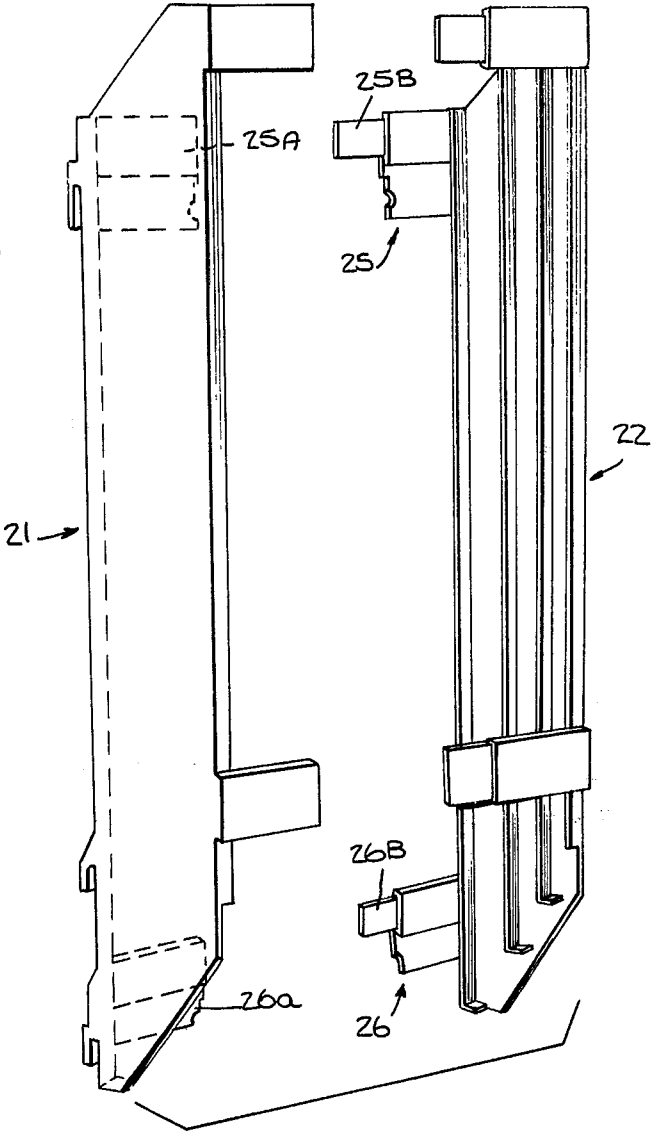
FIG. 10 shows the two pieces from which the unit in FIG. 7 is formed.

Before considering the structure of a storage and dispensing unit in accordance with the invention it may be helpful to review briefly existing injection-molding techniques in that an important aspect of this structure resides in the fact that it may be fabricated in a one-piece injection molding operation and may therefore be produced efficiently and at low cost.

In injection-molding, granular thermoplastic molding material flows from a hopper into a closed cylinder where it is heated and softened, the molten plastic being injected by pressure through a suitable orifice into the cavities of the closed mold. The mold cavities are connected with the nozzle of the heating cylinder by channels through which the plastic material is conducted. The term injection is generally used where the heating chamber or cylinder is charged as a step in a repeating cycle. The injection-molding machine affords a fully automatic process for converting thermoplastic material in granular form to a fully finished product.

An injection mold consists of two major parts. The stationary part is secured to the stationary platen of the machine and, in operation, directly contacts the nozzle in the end of the injection cylinder. The movable part of the mold is attached to the movable platen of the machine and houses the ejector mechanism.

If the configuration of the part to be molded is such that it is free of undercuts, then the part can be fully developed by the mold cavities and the part can be molded in a simple one-piece operation so that the part ejected from the mold is finished and ready for use. Otherwise, where there are undercuts in the part, the complete structure can only be made by molding two or more pieces and thereafter assembling the pieces by secondary operations to produce a complete unit.

As will later become evident, the design of a unit in accordance with the invention, even though it includes ledges projecting from walls, nevertheless avoids undercuts, so that the unit may be fabricated inexpensively and efficiently in a one-piece operation.

Referring now to FIGS. 1 to 6 of the drawing, there is shown a preferred embodiment of a storage and dispenser unit in accordance with the invention, the unit being generally designated by numeral 10. The unit is designed for vertical mounting on a wall or counter. In the case of a counter, the unit may be provided with a suitable stand to hold it in an erect position.

The unit is adapted to hold and dispense small boxes 11 which are received in three distinct compartments A, B and C, the first (A) being the front compartment, the second (B), being the intermediate compartment and the last (C) the rear compartment. While in the embodiment shown the unit has three compartments, it will be appreciated that by using the principles underlying the invention, one may design a unit with only two compartments or with more than three compartments.

Unit 10 is constituted by a back wall 12 and a pair of parallel side walls 13 and 14 secured to the edges of the back wall to define a channel. The corners of the side walls are chamfered to avoid sharp points. Projecting inwardly from side wall 13 is a series of stepped ledges 15, 16 and 17, and projecting inwardly from side wall 14 at corresponding positions is a series of stepped ledges 18, 19 and 20. The front pair of ledges 17 and 20, the intermediate pair of ledges 16 and 19 and the rear pair of ledges 15 and 18 serve to divide the channel into the sub-channels or compartments A, B and C.

The leading edges of the ledge pairs are staggered with respect to back wall 12 to define discharge openings Da, Db and Dc for the respective compartments, thereby permitting lateral numeral of boxes 11 one at a time. The boxes are stacked one above the other within compartments A, B and C and are prevented from sliding out by means of feet or stops Sa, Sb and Sc placed at the lower end of the compartments and abutting side walls 13 and 14.

The long sides of the rectangular ledges are staggered with respect to back wall 12. The front pair of ledges 17 and 20 register wit rectangular slots 16A and 19A formed in the intermediate pair of ledges 16 and 19 respectively, the dimensions of these slots being slightly larger than ledges 17 and 20. Similarly, the intermediate pair of ledges 16 and 19 register with slightly larger rectangular slots 15A and 18A in the rear ledges 15 and 18. And the rear ledges 15 and 18 register with slightly larger rectangular slots 12A and 12B formed in the rear wall 12, these slots being separated by a central strip 12'.

Thus one looking at the unit from the rear, as illustrated in FIG. 6 sees rear ledges 15 and 18 through the slots in the back wall 12, and he sees intermediate ledges 16 and 19 through the slots in rear ledges, the front ledges 17 and 20 being seen through the slots in the intermediate ledges. It will be appreciated therefore that the unit is free of undercuts and that the entire formation may be molded in a one-piece molding operation.

Referring now to FIGS. 4 and 5, it will be seen that when the unit is fully loaded, each of sub-channels A, B and C contains a vertical stack of boxes 11. While discharge openings Da, Db and Dc are staggered, one is able to remove only a single box at a time from sub-channel A, as shown in FIG. 5, until this compartment is entirely empty.

The reason one cannot readily remove a box from the second compartment B while even a single box remains in the front compartment A, is that in order to withdraw a box, one must to grip the box press the forefinger F, as shown in FIG. 1, against the front face of the box while the thumb is placed against the bottom edge of the box. Since the box at the discharge position in the second compartment B has its face blocked by the box in the discharge position in compartment A, one cannot easily make a withdrawal from compartment B until compartment A is empty, and for the same reason one cannot withdraw from compartment C until both compartments A and B are empty. And since only one box can be removed at a time, this discourages unauthorized withdrawals.

Because of the transverse space between the ledge pairs, much of the face of the boxes is exposed to view, so that advertising matter and the product trademark printed on the boxes are exposed. To further enhance the attractiveness of the unit and to increase box exposure, the unit may be made of a transparent plastic, such as an acrylic material.

Second Embodiment

Figure 8:
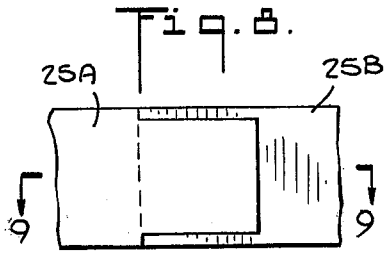
FIG. 8 is a detail showing the manner in which complementary cross strips are joined.
Figure 9:
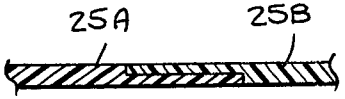
FIG. 9 is a section taken in the plane indicated by line 9—9 in FIG. 8.
Figure 7:
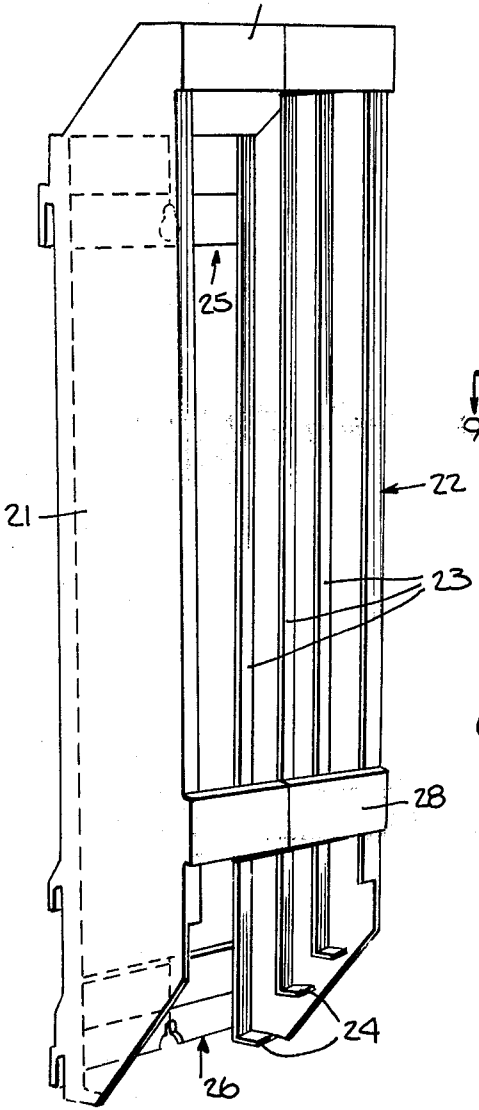
FIG. 7 is a perspective view of a second preferred embodiment of the invention.

Referring now to FIGS. 7 to 10, there is shown another embodiment of the invention in which the storage and dispenser unit is formed of two matching pieces, generally designated by numerals 21 and 23, which are separately molded and then joined together. The resultant structure is functionally identical to the unit shown in FIG. 1 in that the vertical channel formed thereby is divided into distinct sub-channels for receiving small boxes.

Each of pieces 21 and 22 is formed by a side wall having ledges 23 projecting therefrom, the leading edges being staggered to provide discharge openings for lateral removal of the boxes from the sub-channels. The lower ends of the ledges have feet 24 projecting laterally therefrom to prevent the boxes from sliding out. However, there are no openings in these ledges as in the case of FIG. 1, for the unit is not injection molded in a one-piece operation.

The back wall in this instance is formed by upper and lower cross-strips 25 and 26 defined by complementary mortise and tenon elements 25A–25B and 26A–26B, extending from the respective pieces 21 and 22. To rigidify the unit, similar cross-pieces 27 and 28 are provided at the front end of the unit. Thus, after the two pieces are molded, they are united by joining together the complementary elements of the cross-pieces with a suitable bonding agent.

While there have been shown and described preferred embodiments in accordance with the invention, it will be appreciated that many changes and modifications may be made therein without, however, departing from the essential spirit thereof.

I claim:

1. A storage and dispenser unit molded of rigid material and adapted to receive rectangular boxes comprising:

A. a back wall:

B. a pair of side walls secured to the edges of the back wall to define a vertical channel therewith, said side walls being rectangular in form and having their corners chamfered; and C. a series of rectangular ledges secured to and projecting inwardly from each side wall to divide the channel into parallel sub-channels for accommodating said boxes, said series of ledges consisting of a front ledge, an intermediate ledge and a rear ledge, said sub-channels being provided at their lower ends with feet projecting laterally from the ledges to prevent the boxes from sliding out, the leading edges of the ledges being staggered with respect to the back wall to form discharge openings for lateral removal of said boxes, the ledges in the series being of progressively increasing width whereby the long sides thereof are staggered with respect to the back wall, each ledge in the series beginning with the narrowest front ledge registering with a like-shaped slot in the next ledge, the last ledge in the series registering with a like-shaped slot in the back wall whereby the unit is free of undercuts and can be injection-molded in a one-piece operation.

* * * * *

UNITED STATES PATENT OFFICE

CERTIFICATE OF CORRECTION

PATENT NO. : 3,957,174

DATED : May 18, 1976

INVENTOR(S) : JOSEPH P. PALAMARA

It is certified that error appears in the above-identified patent and that said Letters Patent are hereby corrected as shown below:

Column 3, line 61, "wit" should have read --with--.

Column 5, line 9, after "rigid" should have been inserted --plastic--.

Signed and Sealed this

Third Day of August 1976

[SEAL]

*Attest:*

RUTH C. MASON
*Attesting Officer*

C. MARSHALL DANN
*Commissioner of Patents and Trademarks*